US006379236B1

(12) United States Patent
Takizawa et al.

(10) Patent No.: US 6,379,236 B1
(45) Date of Patent: Apr. 30, 2002

(54) FIXTURE FOR ABRASIVE CLOTH PAPER

(75) Inventors: Toshiaki Takizawa; Mitsuru Akeno, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/453,381

(22) Filed: Dec. 2, 1999

(30) Foreign Application Priority Data

Dec. 21, 1998 (JP) ..... 10-362017

(51) Int. Cl.[7] ..... B24B 23/00
(52) U.S. Cl. ..... 451/490; 451/356
(58) Field of Search ..... 451/490, 356, 451/351, 507, 523, 524, 525

(56) References Cited

U.S. PATENT DOCUMENTS 3,842,549 A * 10/1974 Johnston ..... 451/524
5,131,193 A * 7/1992 Demers ..... 451/490
5,337,523 A * 8/1994 Walsh ..... 451/502
5,554,066 A * 9/1996 Bosten et al. ..... 451/356
5,662,519 A * 9/1997 Arnold ..... 451/525
5,749,770 A * 5/1998 Uzumcu et al. ..... 451/356

* cited by examiner

*Primary Examiner*—Robert A. Rose
(74) *Attorney, Agent, or Firm*—Finnegan, Henderson, Farabow, Garrett & Dunner, L.L.P.

(57) ABSTRACT

This invention provides a fixture for an abrasive cloth paper in which a surface fastener does not have to be bonded prior to fixing of the abrasive cloth paper onto the fixture and in which hook-shaped engaging elements are disposed accurately at portions directly related to polishing by an abrasive cloth paper fastening portion of the fixture with precedence. A fixture made of synthetic resin comprises a mounting portion which is engaged with/disengaged from a base plate of a sander and a fastening portion on which an abrasive cloth paper is wound and fastened. In the fastening portion, a plurality of surface fastener engaging element rows which are parallel to a direction of winding of the abrasive cloth paper are formed integrally so as to form a fastening surface. A hollow portion is formed in the fastening portion. Consequently, a complicated work for bonding a male surface fastener to the fixture integrally is eliminated and surface fastener engaging element rows can be arbitrarily formed integrally at required portions on a surface of the fastening portion of the fixture. As a result, the fastening surface composed of the surface fastener engaging element rows can be formed accurately only at portions in which a fastening strength with respect to the abrasive cloth paper needs to be ensured, and no fastening surface FS is formed in a portion not requiring the fastening-strength, thereby leading to reduction of production cost.

6 Claims, 5 Drawing Sheets

FIXTURE FOR ABRASIVE CLOTH PAPER

BACKGROUND OF THE INVENTION

1. Field of the Invention

The present invention relates to a fixture for an abrasive cloth paper which is attachable with/detachable from a polishing base plate of a portable sander and on which an abrasive cloth paper is mounted, and more particularly to a fixture for the abrasive cloth paper applicable for a portable sander which performs polishing at an end portion of the polishing base plate.

2. Description of the Related Art

Various portable sanders have been used to correspond to diversified polishing works conventionally. A main body 2 of the portable sander 1 has a handle 3 and a configuration similar to household electric iron, to/from which a base plate 4 can be removably attached/detached. In some case, a portion of the base plate 4 to be mounted to the main body 2 of the sander is connected to a vibration generating source and in some case, polishing work is carried out just manually. A fixture attaching/detaching portion 5 for attachably/detachably holding the fixture on which a male member of the surface fastener is bonded via adhesive agent, is formed on the surface of an end portion of the base plate 4.

The fixture attaching/detaching portion 5 has a fixture mounting space 5*a* which is surrounded by rectangular wall portions and elongated longitudinally as understood from FIG. 1. On a rear wall face thereof is formed an engaging pawl 5*b* which is projected inwardly in a wedge shape and with/from which an end of the fixture is engaged/disengaged, and then an fastening hole 5*c* is formed from a front wall portion up to a front end surface of the base plate 4 for detachably supporting the other end of the fixture.

Typically, the fixture detachably mounted to the fixture attaching/detaching portion 5 of the base plate 4 is a rectangular block having a substantially eggplant-like section and similar to a configuration of the fixture 10 of the present invention shown in FIG. 1. What is different from FIG. 1 is that a surface of the fastening portion on which a surface fastener is wound and bonded integrally is just a smooth plane. On the surface of the fastening portion of this fixture is bonded a male surface fastener made of fiber well known conventionally or a molded surface fastener of synthetic resin having a plurality of hook-shaped engaging elements formed integrally on a surface of a plate-like substrate with adhesive agent. Then, a pile member (female surface fastener) formed on a rear surface of an abrasive cloth paper is fastened to a fastening surface having the hook-shaped engaging elements of the surface fastener bonded to the fixture 10, thus the abrasive cloth paper is fastened thereto.

However, the configuration of the aforementioned fixture is only an example, and may have various configuration corresponding to a surface shape of a product to be polished, and the fastening portion on which a surface fastener is to be mounted has not only an arc-shaped section as shown in FIG. 1, but also a substantially triangular section, a substantially inverse triangle section, a section in which a bottom portion of a triangular section is curved outward or inward in an arc shape or the like. Bonding and fixing of the surface fastener onto a fixture having such a diversified surface shape of the fastening portion is very troublesome and particularly if the surface of the fastening portion is in a complicated configuration, it is very difficult to fasten the surface fastener to an entire surface of the fastening portion accurately, so that often the surface fastener is bonded such that part thereof is floated.

Regardless of whether the surface fastener is made of fiber or molded of synthetic resin, when it is bonded to the surface of the fastening portion of the fixture, it only has to be bonded firmly to portions directly related to polishing in standpoint of shearing strength. In other words, it is important that the portion related to polishing by the abrasive cloth paper has to be mounted securely on the fixture via the surface fastener. This means that hook-shaped engaging elements of the surface fastener only have to be formed at least on portions directly related to polishing by the abrasive cloth paper. However, when the conventional fixture is used, as described above, the surface fastener has to be bonded and fixed on an entire surface of the fastening portion of the fixture, and at this time of bonding, deflection of position is likely to occur. Thus, to cope with such a phenomenon, the hook-shaped engaging elements need to be formed on a portion of the substrate where the elements may be unnecessary.

SUMMARY OF THE INVENTION

Accordingly, the present invention has been accomplished to solve such a conventional problem, and therefore it is an object of the invention to provide a fixture for an abrasive cloth paper in which a surface fastener does not have to be bonded prior to fixing of the abrasive cloth paper onto the fixture and in which hook-shaped engaging elements are disposed accurately at a portion directly related to polishing by an abrasive cloth paper fastening portion of the fixture with precedence.

According to an aspect of the present invention, there is provided a fixture for an abrasive cloth paper comprising a mounting portion which is attachable with/detachable from a base plate of a sander and a fastening portion on which the abrasive cloth paper is wound and fastened. And the fastening portion has a fastening surface in which a plurality of surface fastener engaging elements are formed integrally. With such a structure, a troublesome work for bonding the surface fastener to the fastening portion of the fixture via adhesive agent is eliminated and production cost is reduced thereby ensuring a very reasonable price.

Preferably, the surface fastener engaging element rows are composed of a plurality of hook-shaped engaging elements and reinforcement ribs are formed integrally on both sides of each hook-shaped engaging element. The abrasive cloth paper is fastened to the fastening portion of the fixture for polishing work. At this time, a very large force from multiple directions is applied to the hook-shaped engaging elements on which the abrasive cloth paper is fastened. Thus, the hook-shaped engaging elements are repeatedly bent so that breaking of their root portions often occurs. The aforementioned reinforcement rib reinforces particularly a stem portion of the hook-shaped engaging element so as to prevent breaking thereof due to repeated bending.

Further preferably, the fastening surface is composed of a plurality of surface fastener engaging element rows each including a plurality of hook-shaped engaging elements having the same directivity, arranged in parallel to a direction of winding of the abrasive cloth paper and the fastening surface includes surface fastener engaging element rows in which the direction of hooks are opposite. Because the direction of the hook of the hook-shaped engaging elements constituting part of the plurality of surface fastener engaging element rows is made opposite to that of the hook of the hook-shaped engaging elements constituting other surface fastener engaging element rows, a required fastening force with respect to the abrasive cloth paper resisting a large force applied from multiple directions as mentioned above is ensured.

Preferably, the fastening surface is formed not on the entire region of the fastening portion but a region in which the fastening surface does not exist is provided in part of the fastening portion. Although a part of the abrasive cloth paper most contributing to polishing at the polishing time has to be firmly fixed on the fixture, the other part only has to be just fixed to the fixture. Thus, the surface fastener engaging element rows don't have to be disposed on a portion not related directly to polishing by the fixture. Such a structure can be achieved easily by forming the surface fastener engaging element rows integrally with the fixture. Meanwhile, the region in which the fastening surface does not exist can be formed arbitrarily based on other reasons than the aforementioned reason.

Also preferably, the fastening portion of the fixture includes a hollow portion inside thereof. Because the fixture is usually made of hard synthetic resin or rubber, it strikes a surface to be polished too strongly at the polishing time. Thus, the aforementioned hollow portion is formed so as to apply a predetermined elasticity to, at least, a fastening portion most related to polishing. The degree of the elasticity can be adjusted depending on a size of the hollow portion.

And preferably, the mounting portion includes a pair of engaging protrusions which are protruded in opposite directions to each other and a through hole is formed in the vicinity of each of the engaging protrusions in a direction perpendicular to the protruding direction of the engaging protrusion. This through hole applies a required elasticity in the vicinity of the engaging protrusion of the mounting portion like the aforementioned hollow portion and allows the engaging protrusion to be engaged with/disengaged from the mounting portion of the base plate.

DESCRIPTION OF THE PREFERRED EMBODIMENTS

Hereinafter, the preferred embodiments of the present invention will be described with reference to the accompanying drawings.

Figure 1:
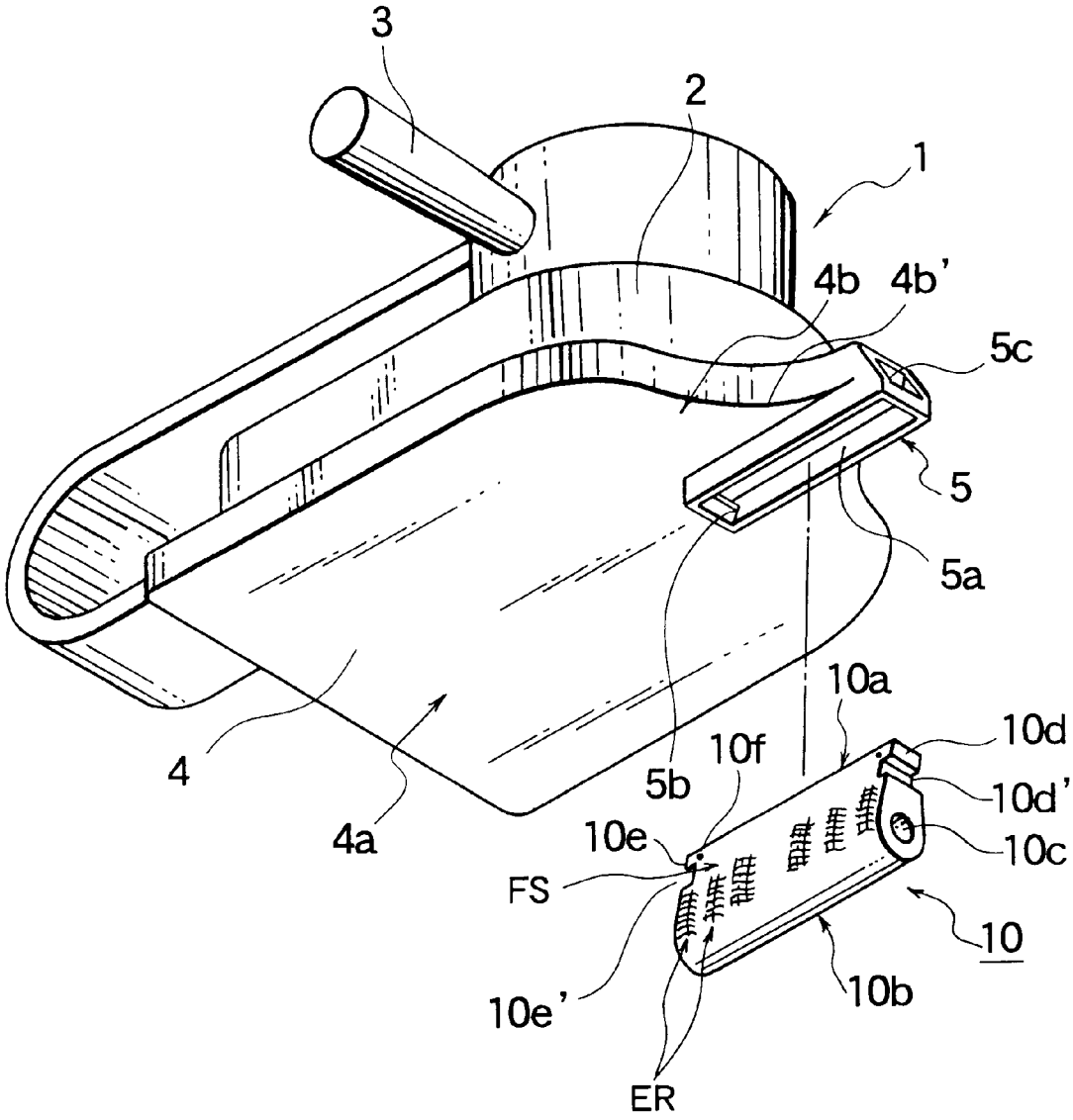
FIG. 1 is an exploded perspective view of a portable sander of a typical embodiment to which an abrasive cloth paper fixture is applied and the same fixture of the invention.

FIG. 1 shows a schematic structure of a portable sander according to a typical embodiment of the present invention. In FIG. 1, reference numeral 1 denotes a portable sander. This portable sander 1 shown in FIG. 1 is a manual sander containing a handle 3 being disposed to a main body 2 and no vibration generating apparatus inside the main body 2. Of course, this invention is not limited to the manual type, but applicable to an automatic sander including an electric vibration generating apparatus inside the main body.

A flat-plate metallic base plate 4 is fixed to a bottom of the main body 2. The base plate 4 may be of synthetic resin. This metallic base plate 4 is in a form of a plate constituted of a rectangular portion 4*a* (hereinafter referred to as base plate rear portion) and a substantially isosceles triangle portion 4*b* (hereinafter referred to as base plate front portion) having a sharp angle corner portion 4*b'* at an end thereof. A fixture attaching/detaching portion 5 having a longitudinally narrow fixture mounting space 5*a,* which is surrounded by rectangular wall portions, is formed from the sharp angle corner portion 4*b'* nearly up to a border line between the sharp angle corner portion 4*b'* and the base plate rear portion 4*a.* An engaging pawl 5*b* which an end of a fixture 10 of the present invention engages with/disengages from is formed on a rear wall of the fixture attaching/detaching portion 5 so as to protrude inward in a wedge shape and a fastening hole 5*c* for detachably supporting the other end of the fixture 10 is formed from the front wall portion up to a front end of the base plate 4. Such a structure is substantially not different from that of a conventional one.

The fixture 10 for the abrasive cloth paper of the present invention is composed of a molded product of synthetic resin and comprises a mounting portion 10*a* which can be attached with/detached from the fixture mounting space 5*a* of the aforementioned fixture attaching/detaching portion 5 formed on the base plate 4 of the sander 1 and a fastening portion 10*b* on which an abrasive cloth paper 11 is wound and fastened. The fastening portion 10*b* has a fastening surface FS in which a plurality of surface fastener engaging element rows ER are integrally formed so as to be parallel to a winding direction of the abrasive cloth paper 11. As material for forming this fixture, polyester elastomer resin and various kinds of hard rubbers can be used.

According to this embodiment, as shown in FIGS. 1 to 4, the mounting portion 10*a* of the fixture 10 is a elongated cuboid having a substantially trapezoidal section. The aforementioned fastening portion 10*b* is provided integrally on a bottom of the mounting portion 10*a* and has a section surrounded by a circular portion larger than a half circle and a tangent line on the same circle. A blind-hole like hollow portion 10*c* is formed around a center line of the half circle section portion from front and rear end faces of the fastening portion 10*b* up to a substantially center portion. Because the fixture 10 is made of hard resin, this hollow portion 10*c* is provided so as to ensure some extent of flexibility at the front and rear portions of the fixture 10 at the time of polishing. The degree of the flexibility can be adjusted by changing the hole diameter of the hollow portion 10*c*.

A pair of front and rear engaging protrusions 10*d* and 10*e* protruding in opposite directions, each having the same shape which can be engaged with/disengaged from the fixture mounting space 5*a* of the fixture attaching/detaching portion 5 formed on the base plate 4 are provided at both end portions in the length direction of the mounting portion 10*a*. As illustrated, protruding end faces of the engaging protrusions 10*d* and 10*e* are flush with the front and rear end faces of the fastening portion 10*b*. Therefore, according to this embodiment, the respective engaging protrusions 10*d* and 10*e* are defined by grooves 10*d'* and 10*e'* extending to the right and left on end faces of borders between the mounting portion 10*a* and fastening portion 10*b*. Through holes 10*f* are formed in a direction perpendicular to the protruding direction of the engaging protrusions 10*d* and 10*e* in the vicinity of the respective engaging protrusions 10*d* and 10*e*. This through hole 10*f* provides the aforementioned protrusions 10*d* and 10*e* and adjacent portions with a required flexibility like the hollow portion, so that when the protrusions 10*d* and 10*e* are engaged with/disengaged from the fastening hole 5*c* and engaging pawl 5*b* formed front and rear portions of the fixture attaching/detaching portion 5, the portions adjacent to the protrusions 10*d* and 10*e* are elastically deformed easily.

Figure 3:
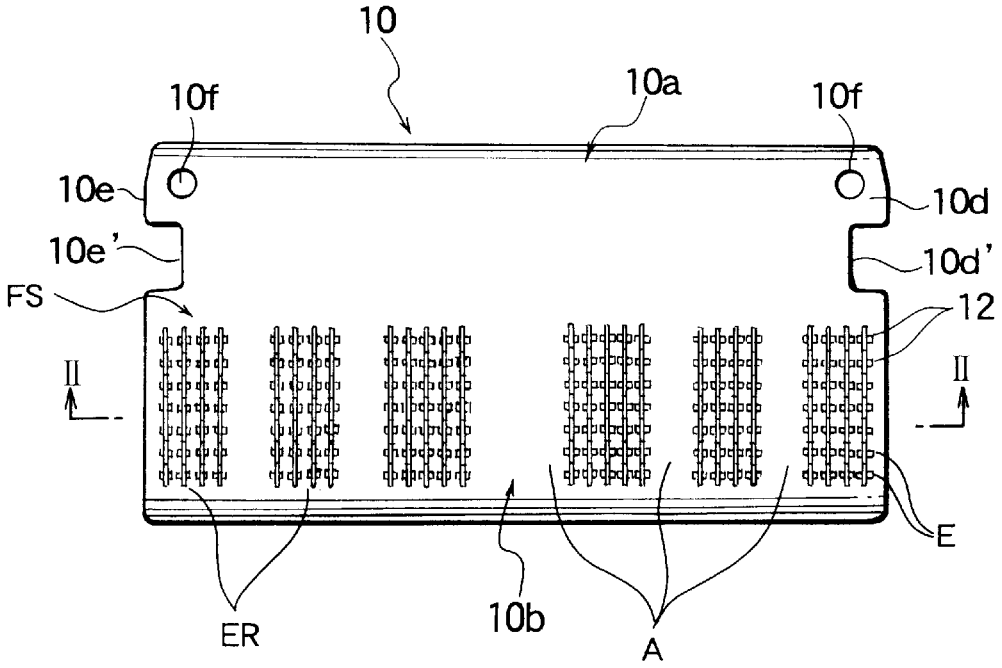
FIG. 3 is a side view of the same fixture.
Figure 4:
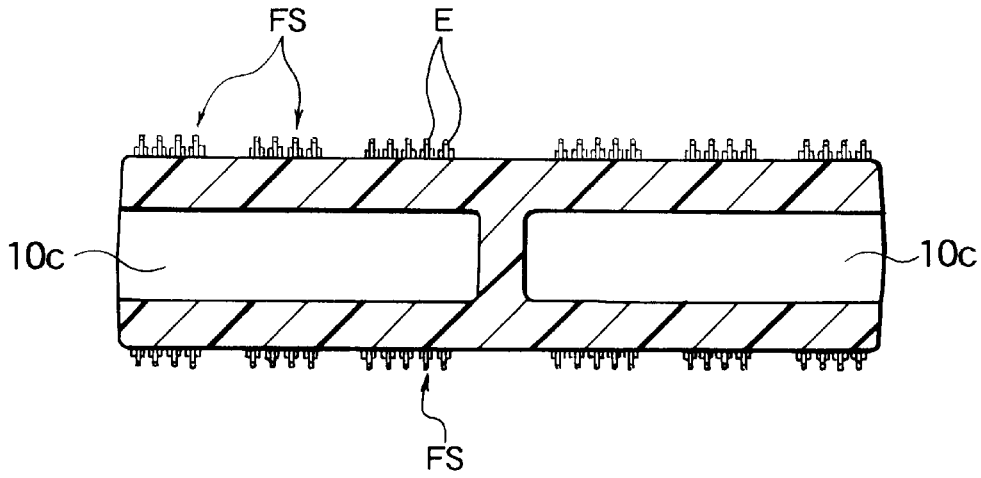
FIG. 4 is a sectional view taken along the line II—II of FIG. 3.

Further, according to this embodiment, the fastening surfaces FS, each of which is formed of a plurality of the surface fastener engaging element rows ER formed integrally with the fastening portion 10*b,* is composed of a plurality of groups of the surface fastener engaging element rows ER, the surface fastener engaging element rows ER being aligned in the longitudinal direction on right and left side of the fastening portion 10*b* as shown in FIGS. 1, 3 and 4. Therefore, a plurality of the fastening surfaces FS are formed with a non-forming region A of the surface fastener engaging element row ER disposed between adjacent ones. In the illustrated example, two fastening surfaces FS disposed on the front and rear are respectively composed of four surf ace fastener engaging element rows ER and two fastening surfaces FS in the center are composed of five surface fastener engaging element rows ER.

Figure 2:
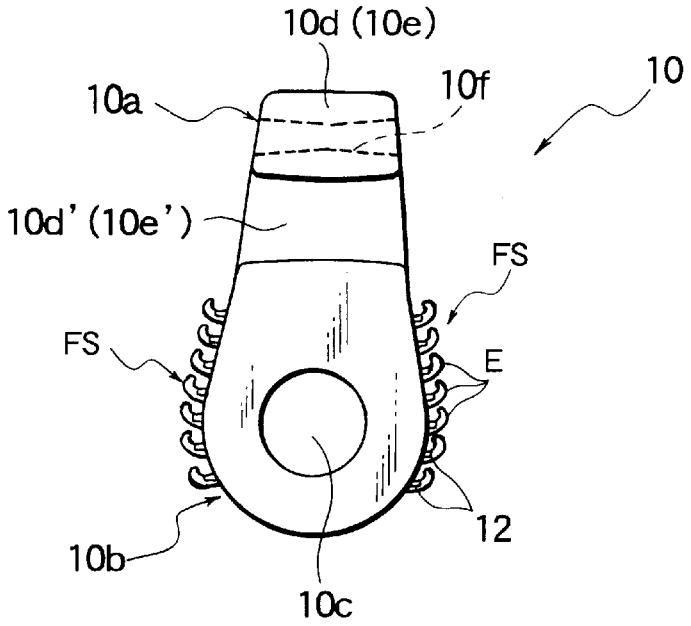
FIG. 2 is a front view of the same fixture.

In each surface fastener engaging element row ER, seven hook-shaped engaging elements E are disposed such that the hooks faces upward in the same direction as shown in FIG. 2. With this hooking direction, the abrasive cloth paper 11 is wound up such that it is hooked, thereby ensuring a secure fastening of the abrasive cloth paper 11 so that it is not released. The direction of hooking of the hook-shaped engaging elements E of some surface fastener engaging element rows ER is opposite to that of the hook-shaped engaging elements E disposed in other surface fastener engaging element rows ER.

Because the abrasive cloth paper 11 fastened to the fastening surfaces FS formed by the hook engaging elements E disposed in the respective groups receives a force from all directions upon polishing operation, external force from multi-directions is applied to the hook-shaped engaging elements E for fixing the same abrasive cloth paper 11. Therefore, a fastening force between the abrasive cloth paper 11 and the fastening surface FS composed of the hook-shaped engaging elements E needs to be strong enough for bearing the force from multi-directions. By disposing the hook-shaped engaging element rows ER such that the directions of hooking are opposite to each other, a sufficient engaging force capable of bearing the force of multi-directions applied to the fastening surface FS is ensured.

Because upon polishing, forces of all directions are applied to hook-shaped engaging elements E forming the surface fastener engaging element rows ER of the fixture 10 as described above and the force is very large, bending of the hook-shaped engaging element E from its root is repeated, so that they are often damaged. Therefore, according to this embodiment, reinforcement ribs 12 are formed integrally with the fastening portion 10*b* on side faces of each of the hook-shaped engaging elements E, perpendicularly to the hooking direction thereof.

FIGS. 5 to 8 show modifications of the aforementioned fixture 10. In these modifications, a sectional shape of the fixture 10 is formed to correspond to a shape of a portion to be polished of a polishing-object product so as to ensure easiness and accuracy of the polishing work. Meanwhile, in these modifications, the like reference numerals are attached to corresponding components of respective embodiments.

Figure 5:
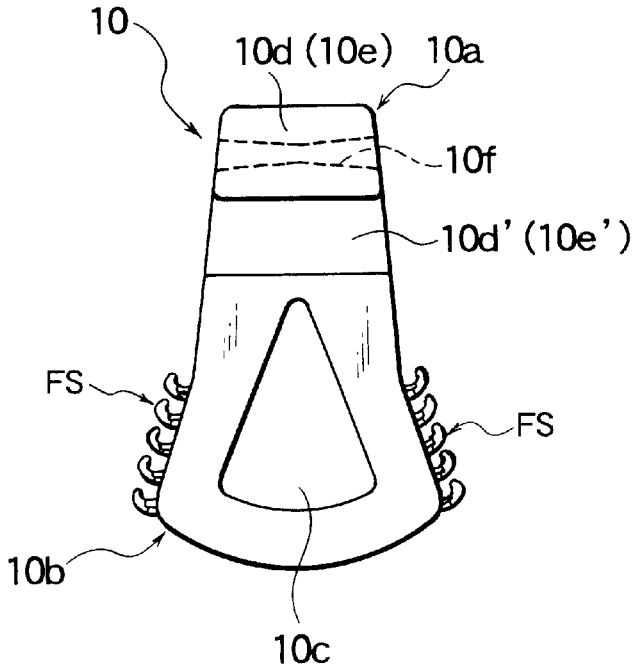
FIG. 5 is a front view showing a modification of the fixture.

In a modification shown in FIG. 5, a sectional shape of the fastening portion 10*b* of the fixture 10 is substantially fan shaped and the hollow portion 10*c* having a substantially triangular section is formed longitudinally substantially along a center line thereof. No hook-shaped surface fastener engaging element row ER is provided on an arc portion on the bottom and five hook-shaped engaging elements E are disposed in each surface fastener engaging element row ER formed on the right and left side faces.

Figure 6:
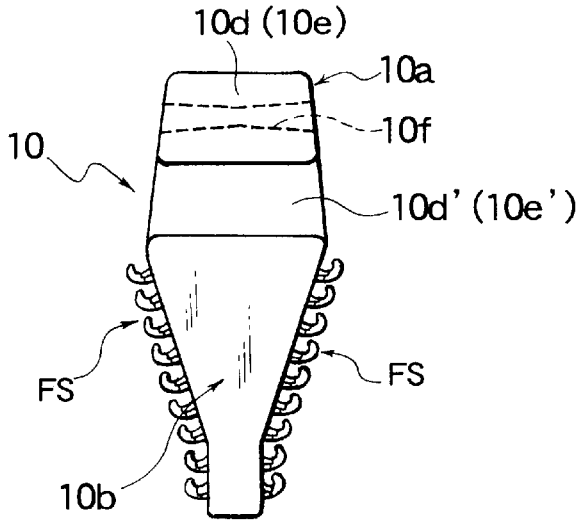
FIG. 6 is a front view showing another modification of the fixture.
Figure 7:
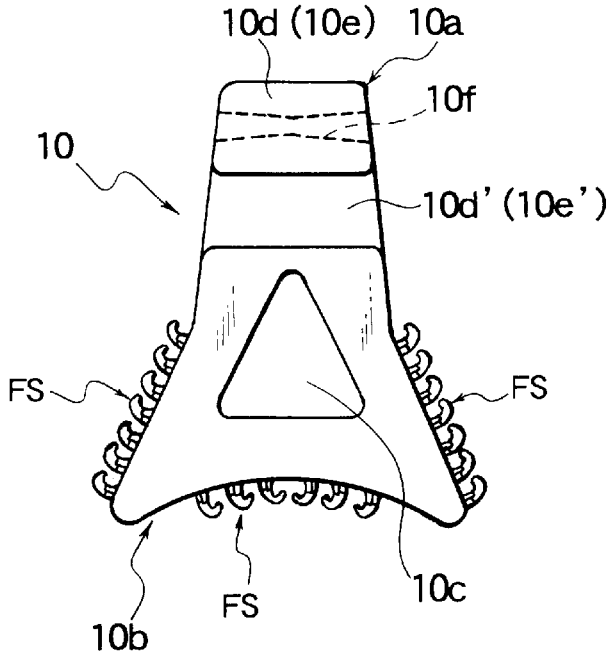
FIG. 7 is a front view showing still another modification of the fixture.
Figure 8:
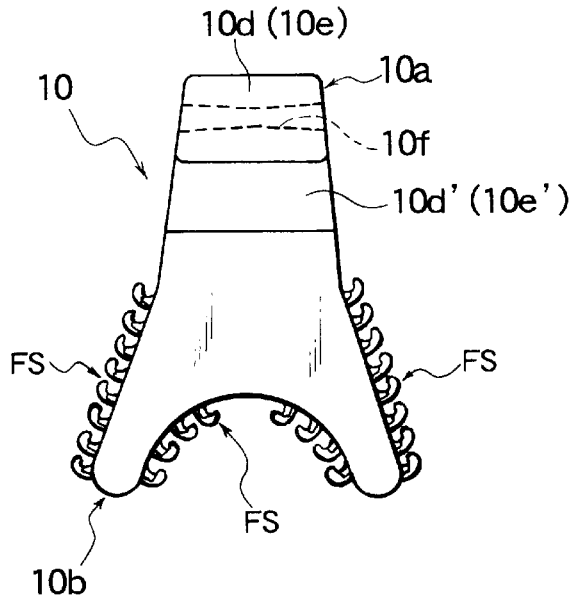
FIG. 8 is a front view showing still another modification of the fixture.

In a modification shown in FIG. 6, the sectional shape of the fastening portion 10*b* is inverse isosceles triangle, with an elongated rectangle extending from a vertex thereof. No surface fastener engaging element row ER is formed on a bottom of that rectangular portion. In modifications shown in FIGS. 7 and 8, the sectional shape of the fastening portion 10*b* includes a curved face formed by curving a bottom of isosceles triangle portion inward in a circular arc shape. The curvature radii of the curved faces thereof are different. Further, in the modification shown in FIG. 7, the hollow portion 10*c* having an isosceles triangular-shaped section is formed along a center line of the fastening portion 10*b*.

In both the modifications, in addition to the right and left sides, the surface fastener engaging element rows ER are formed also on the curved face so as to form the fastening surface FS. Both in the modifications shown in FIGS. 7 and 8, the directions of the hook-shaped engaging elements E disposed in the respective surface fastener engaging element rows ER formed on the curved face are opposite to each other across the center line of the curved face. Then, in the fixture 10 shown in FIG. 7, the fastening surface FS composed of the plurality of the surface fastener engaging element rows ER formed on the curved face is concentrated in the center portion of the curved face, but not formed near the right and left edges thereof. Conversely, in the fixture 10 shown in FIG. 8, the fastening surface FS is not formed in the center portion of the curved face but the fastening surface FS is divided to right and left portions such that they are separated across the center line. This configuration is made to correspond to a shape of a portion to be polished of the polishing object product and intensify a fastening force of the abrasive cloth paper at portions to be used for polishing.

Figure 9:
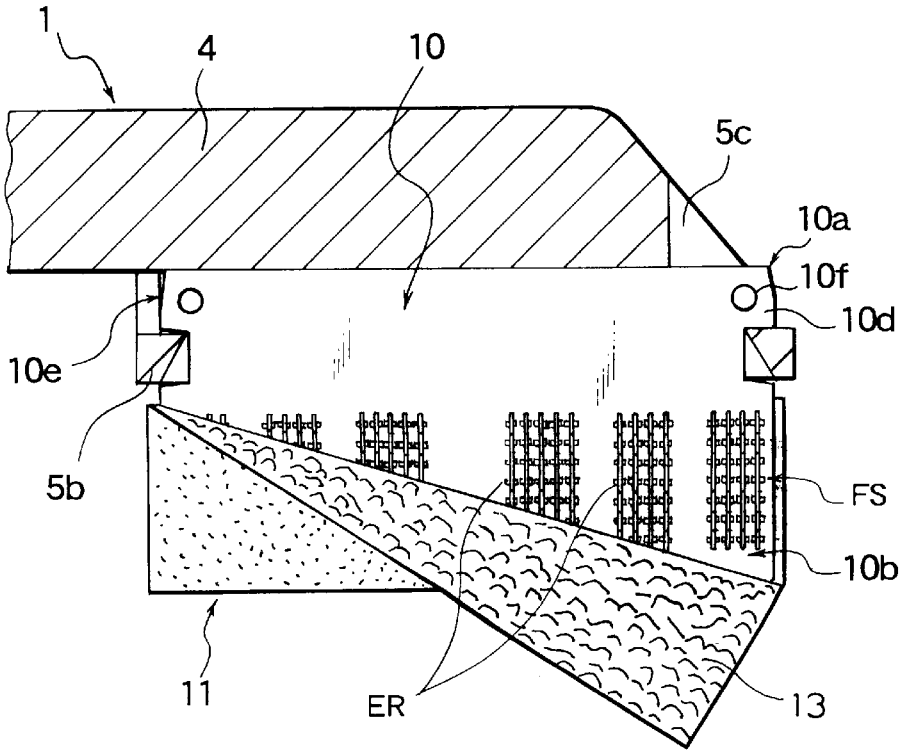
FIG. 9 is a side view showing a mounting condition of the fixture to a sander base plate and a fixing condition of an abrasive cloth paper to a mounting face of the fixture.

FIG. 9 shows a condition in which the fixture 10 is mounted on the base plate 4 of the sander 1 and a condition in which the abrasive cloth paper 11 is fastened to the fastening portion 10*b* of the fixture 10.

When the fixture 10 is mounted onto the fixture attaching/detaching portion 5 formed on the base plate front portion 4*b* of the sander 1, the pair of the front and rear engaging protrusions 10*d* and 10*e* of the fixture 10 are pressed into the fastening hole 5*c* and engaging pawl 5*b* formed on the front and rear portions of the fixture attaching/detaching portion 5 in an elastically deformed state and engaged with the fastening hole 5*c* and engaging pawl 5*b*. As a result, the fixture 10 is fixed as shown in FIG. 9. On the other hand, a female surface fastener 13 having a plurality of loops are bonded on the rear face of the abrasive cloth paper 11. The same female surface fastener 13 is wound along the fastening surface FS of the fixture 10 and pressed thereto, so that it is fixed to the fixture 10. When the fixture 10 is removed from the fixture attaching/detaching portion 5 of the base plate 4, the fastening portion 10*b* of the fixture 10 is grasped and then, the respective protrusions 10*d* and 10*e* are pulled out of the fastening hole 5*c* and engaging pawl 5*b*. Consequently, the respective protrusions 10*d* and 10*e* are elastically bent at portions around the through holes 10*f* so that they can be removed easily.

In the fixture 10 for the abrasive cloth paper 11 of the present invention, a complicated work for bonding the male surface fastener to the fixture 10 with adhesive agent is eliminated and further, the surface fastener engaging element rows ER can be formed arbitrarily at required portions of a surface of the fastening portion 10*b* of the fixture 10. Therefore, the fastening surface FS composed of the surface fastener engaging element rows ER can be formed accurately only at portions in which a fastening strength with respect to the abrasive cloth paper 11 is required and no fastening surface FS is formed at portions not requiring the fastening strength, thereby leading to reduction of production cost.

Although the typical embodiments of the present invention and modifications thereof have been described above, the present invention is not limited to these examples. For instance, the hook-shaped engaging element E which is a component of the surface fastener engaging element rows ER formed on the fixture 10 is not limited to the shapes shown in the figures, but it should be understood that the present invention can be modified in various ways within a scope not departing from the spirit thereof.

What is claimed is:

1. A fixture for an abrasive element comprising:

a mounting portion which is attachable to and detachable from a base plate of a sander and a fastening portion on which an abrasive element is wound and fastened, wherein said fastening portion has a fastening surface in which a plurality of surface fastener engaging elements are formed integrally in a plurality of rows;

wherein each of said rows of surface fastener engaging elements comprises a plurality of hook-shaped engaging elements having the same directivity, arranged in parallel to a direction of winding of the abrasive element; and wherein said surface fastener engaging element rows of said fastening surface having hooks facing in a direction opposite to hooks of other hook-shaped engaging element rows.

2. The fixture for an abrasive element according to claim 1, wherein said surface fastener engaging elements are composed of hook-shaped engaging elements and reinforcement ribs are formed integrally on side faces of each hook-shaped engaging element.

3. The fixture for an abrasive element according to claim 1, wherein said abrasive element comprises at least one of the following: an abrasive cloth and an abrasive paper.

4. The fixture for an abrasive element according to claim 1, wherein said fastening portion comprises a region in which said fastening surface does not exist.

5. The fixture for an abrasive element according to claim 1, wherein said fastening portion comprises a hollow portion inside thereof.

6. The fixture for an abrasive element according to claim 1, wherein said mounting portion comprises a pair of engaging protrusions which are protruded in opposite directions to each other for engaging with or disengaging from said base plate and a through hole is formed in the vicinity of each of said engaging protrusions in a direction perpendicular to the protruding direction of said engaging protrusion.

* * * * *